US007165626B2

(12) United States Patent
Treddenick

(10) Patent No.: US 7,165,626 B2
(45) Date of Patent: Jan. 23, 2007

(54) FIRE PREVENTION FENCE

(76) Inventor: George A. Treddenick, 234 Kingston Row, Winnipeg, Manitoba (CA) R2M 0T4

( * ) Notice: Subject to any disclaimer, the term of this patent is extended or adjusted under 35 U.S.C. 154(b) by 135 days.

(21) Appl. No.: 10/973,097

(22) Filed: Oct. 26, 2004

(65) Prior Publication Data

US 2005/0145396 A1 Jul. 7, 2005

Related U.S. Application Data

(60) Provisional application No. 60/513,986, filed on Oct. 27, 2003.

(30) Foreign Application Priority Data

Oct. 25, 2004 (CA) ..... 2486384

(51) Int. Cl.
*A62C 8/00* (2006.01)
*A62C 35/00* (2006.01)

(52) U.S. Cl. ..... 169/48; 169/49; 169/50; 169/16

(58) Field of Classification Search ..... 169/48, 169/49, 50, 14, 16, 26, 56; 239/548, 549, 239/398, 407, 409
See application file for complete search history.

(56) References Cited

U.S. PATENT DOCUMENTS

| | | | | |
|---|---|---|---|---|
| 3,425,630 | A | 2/1969 | Fessler, Sr. | |
| 3,576,212 | A * | 4/1971 | Siler | 169/48 |
| 3,701,477 | A * | 10/1972 | Matt et al. | 239/276 |
| 3,872,927 | A * | 3/1975 | Stults | 169/48 |
| 3,877,526 | A * | 4/1975 | Dolbeer et al. | 169/48 |
| 4,925,096 | A * | 5/1990 | Gill | 239/10 |
| 6,125,941 | A * | 10/2000 | Lokken | 169/50 |
| 6,450,264 | B1 | 9/2002 | Christian | |

* cited by examiner

*Primary Examiner*—Davis Hwu
(74) *Attorney, Agent, or Firm*—Adrian D. Battison; Michael R. Williams; Ryan W. Dupuis

(57) ABSTRACT

A fire prevention apparatus includes a fence to surround an area to be protected where a top rail of the fence defines a pipe for a sprinkler system such that a water supply can be pumped to provide water to the sprinkler system which is controlled to provide pressure for regularly spraying the area along the fence with herbicides to control vegetation and underbrush and when required to provide pressure to the system when heat is detected by a sensor such that the sprinkler system applies water to the area to suppress an approaching fire.

3 Claims, 3 Drawing Sheets

1
2
2
3
5
6
7
11
13
15
17
19
20
21

FIRE PREVENTION FENCE

This application claims priority under 35 U.S.C. 119 from U.S. Provisional Application Ser. No. 60/513,986 filed Oct. 27, 2003.

FIELD OF THE INVENTION

The present invention relates to a fire prevention fence arranged to provide a fire break surrounding a protected area.

BACKGROUND

In areas of high fire risk it is important to protect residential buildings, commercial buildings are well as buildings that are isolated. Also, areas such as towers and the like can be located in areas that have high fire risks. These areas may sometimes be overgrown with underbrush which can cause a fire to spread quickly. When fighting such fires, it is important to provide the area with a fire break which prohibits a fire from spreading.

U.S. Pat. No. 6,450,264 (Christian) is a sprinkler system arranged to be mounted onto a house to prevent brush and forest fires from engulfing the home. The sprinkler system is mounted directly onto the home but does not particularly provide a fire break between the home and the fire.

U.S. Pat. No. 3,425,630 (Fessler) discloses a sprinkler system mounted onto a fence. The system is primarily used for irrigation and the patent does not mention using the system for providing a fire break and does not disclose any method of doing so.

SUMMARY

According to the present invention there is provided a fire prevention apparatus comprises:

a fence arrangement being arranged to surround an area to be protected;

a sprinkler system incorporated within the fence arrangement;

a water supply arranged to provide water to the sprinkler system;

a control arrangement being arranged for controlling the flow of water to the sprinkler system;

the control arrangement providing pressure to the system for regularly spraying the area along the fence with herbicides to control vegetation and under brush;

the control arrangement providing pressure to the system when heat is detected by a sensor such that the sprinkler system applies water to the area to suppress an approaching fire.

Preferably the fence arrangement includes a top rail which forms a pipe for the sprinkler system.

Preferably the sprinkler system includes a supply tank and an injector for adding materials to the water to be sprayed.

Preferably the sprinkler system includes a first set of nozzles for spraying herbicide to inhibit vegetation on either side of the fence and a second set of nozzles for spraying water for dousing a fire adjacent the fence.

BRIEF DESCRIPTION OF THE DRAWINGS

In the accompanying drawings, which illustrate an exemplary embodiment of the present invention.

DETAILED DESCRIPTION

Figure 1:
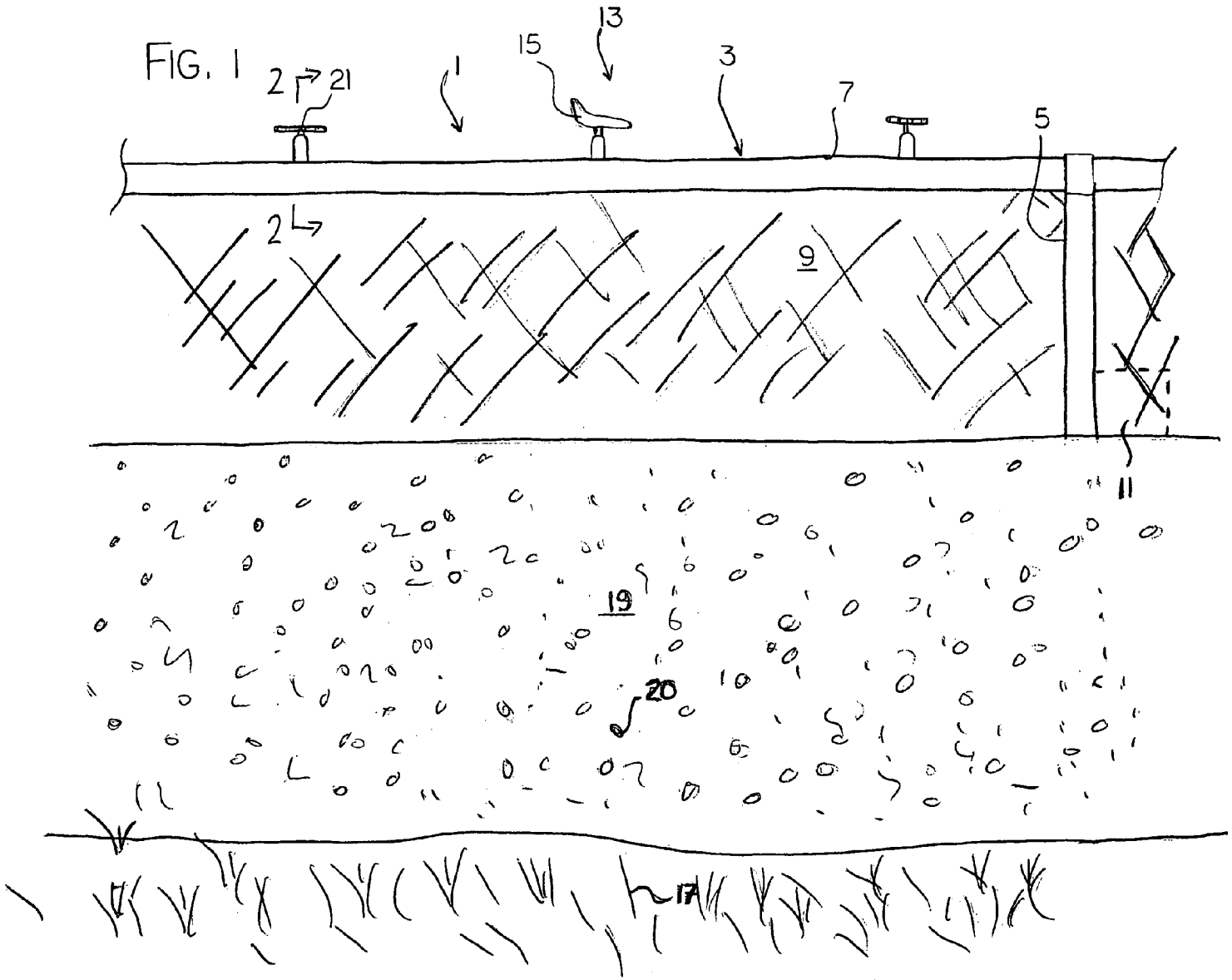
FIG. 1 is a side elevational view of a fire prevention fence according to the present invention.
Figure 2:
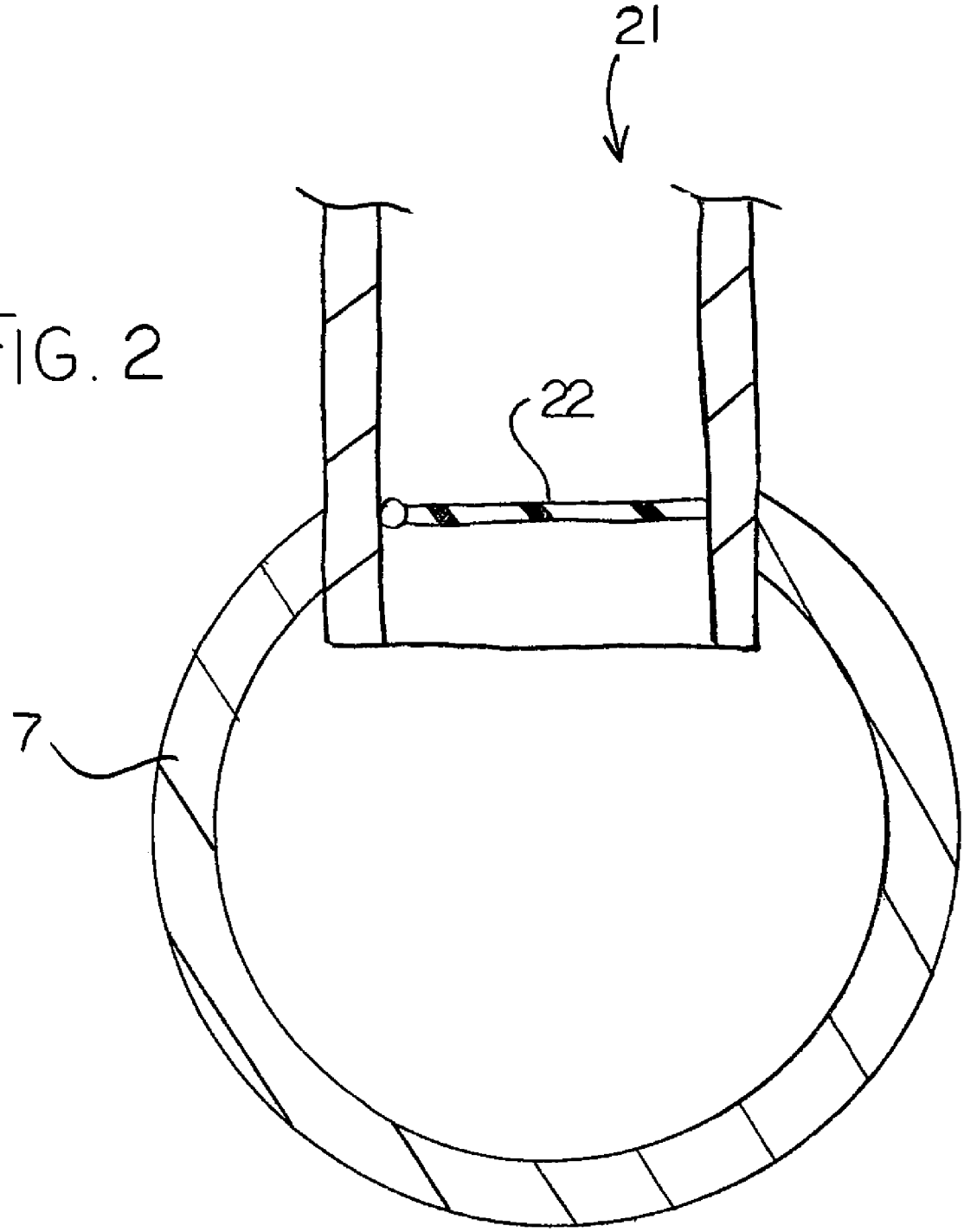
FIG. 2 is vertical cross section along the lines 2—2 of FIG. 1.
Figure 3:
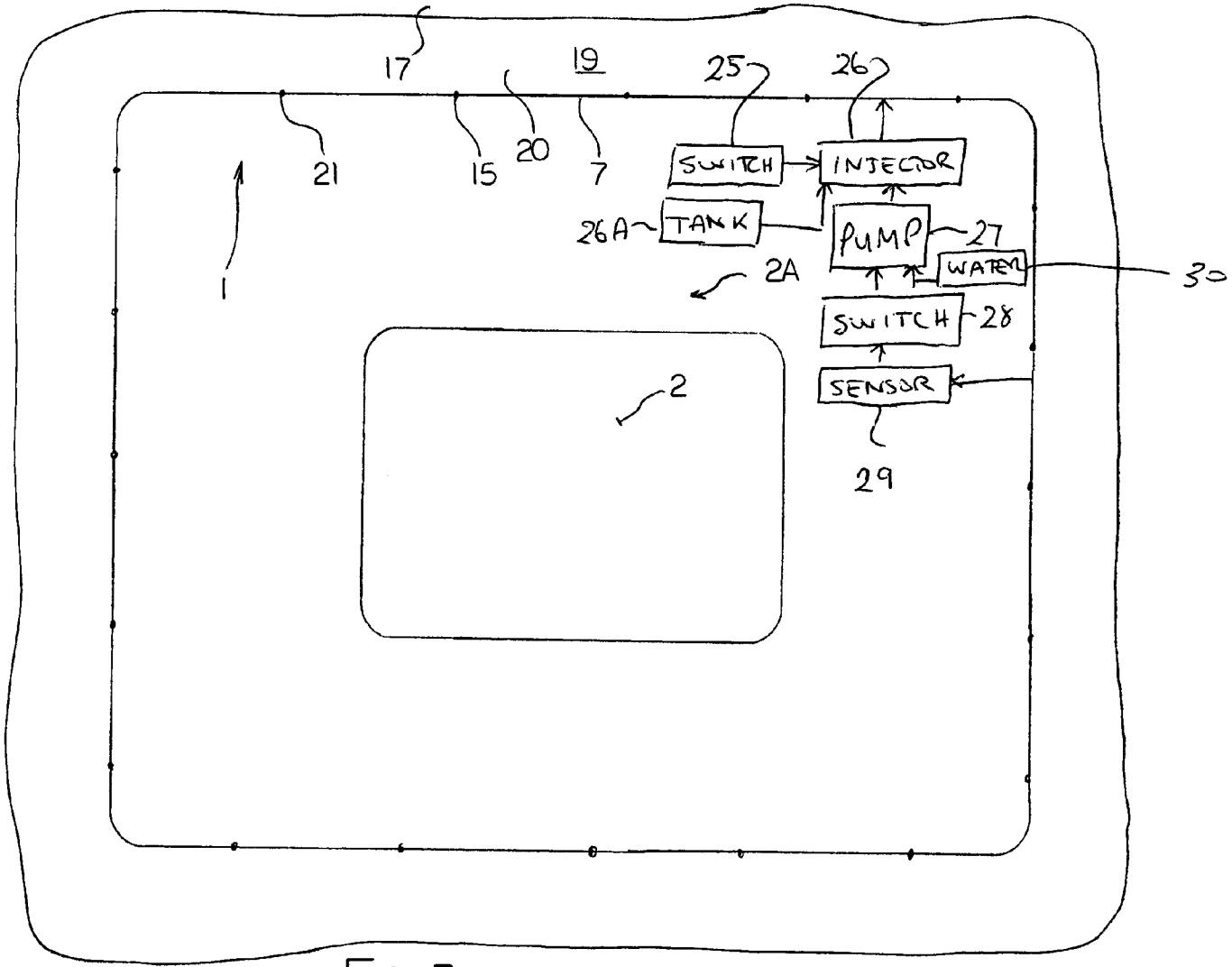
FIG. 3 is a top plan view of an area surrounded by the fence of FIG. 1.

Referring to the accompanying drawings, there is illustrated a fire prevention apparatus 1. The apparatus is arranged to protect structures 2 or areas 2A, commercial, residential or any isolated areas from fire. The apparatus has a fence arrangement 3 which is arranged to surround a building or the like. The fence is similar in design to a conventional chain link fence, in that is has a plurality of vertically mounted posts 5 wherein a rail 7 extends from each post. A chain link 9 encloses the space between adjacent posts and beneath the rail. Each rail is water tight and is arranged to receive water from a pump 11. The rail has a sprinkler system 13. The sprinkler system is arranged to receive water from a supply 30 pumped through the rail by the pump 27 such that the surrounding area of the fence can be sprayed with water or other substances.

A first series of sprinkler heads 15 are generic lawn sprinkler heads and are arranged to maintain the area around the fence by spraying herbicide mixed into the water from the supply 30 by an injector 26 from a tank 26A to keep vegetation such as underbrush 17 and such under control. The underbrush is controlled such that if a fire were to extend towards the area, the lack of underbrush or burnable landscape causes a fire break 19. Preferably the area sprayed to control vegetation is filled with a gravel surface 20 or the like to further create a fire block.

A second series of sprinkler heads 21 are arranged to be activated under high heat conditions for suppressing a fire. The sprinkler heads are arranged to spray an area around the fence containing a fire outside the area to be protected such that the fire does not or is hindered from reaching the building or structure within the fenced off area. The second series of sprinkler heads have a one way valve 22 which is arranged to maintain the pressure generated by the pump in the rail. Once the pressure within the rail is lowered by the valves opening under heat activation to release the water, the pump 27 automatically is activated by a sensor 29 and a switch 28 which in turn forces water into the system and out the second sprinklers.

As mentioned a first use for the system is to protect structures/areas from fire using the top rail of a chain link fence to supply water to fire suppression equipment, for instance, auto sprinkler heads, commercial irrigation sprinklers activated by sensing devices, or manually operated. The top rail or any fence or perimeter wall can be adapted using an installed water pipe with fire suppression equipment installed.

A second use is to provide protection for required sites from burglary, vandals and varmints using tanks containing required materials. The injector 26 can be used to inject material into the water system from the tank 26A. Materials from the tank may include, but are not limited to, pepper spray, dye or non toxic glowing liquid or combination of all three. This system can be activated by automatic sensing devices or by manual operation activating the switches 25 and 28. A drop in water pressure detected by the sensor 29 can also activate an audio/light alarm and transmit an alarm to a central reporting agency.

A third use, as mentioned, is for irrigation using automatic, timer or manual operation, to control vegetation and dangerous underbrush surrounding site, using tanks containing herbicides and using injectors to supply material to water supply. The system can be operated by automatic, remote or manual operation.

Alternatively, a portable or mobile system can be provided for temporary use to protect airplanes, temporary structures and forest fire lighting camps. This system is ideal for remote locations such as TV transmitter stations, remote storage facilities, explosive bunkers, pipeline pumping stations or any remote high risk areas.

The system can also include underground sprinklers which are actuated when heat approaches for dousing the fire.

While one embodiment of the present invention has been described in the foregoing, it is to be understood that other embodiments are possible within the scope of the invention. The invention is to be considered limited solely by the scope of the appended claims.

The invention claimed is:

1. A fire prevention apparatus comprising:

a fence arrangement arranged to surround an area to be protected;

the fence arrangement including a plurality of posts upstanding from the ground and an upstanding fencing material connected between the posts;

a sprinkler system incorporated on the fence arrangement;

a water supply arranged to provide water to the sprinkler system;

a control arrangement arranged for controlling the flow of water to the sprinkler system;

a supply tank containing a herbicide and an injector for adding the herbicide to the water to be sprayed;

the control arrangement being arranged in a first mode of operation to provide pressure to the sprinkler system using said supply tank and injector to supply the herbicide to the sprinkler system;

the sprinkler system being arranged in the first mode for regularly spraying an area along at least one side of the fence to a position spaced from the fence with the herbicide to control vegetation and underbrush along said at least one side of the fence;

a sensor for detecting heat adjacent the fencing arrangement;

the control arrangement being arranged in a second mode of operation, to provide pressure to the system when heat is detected by the sensors;

the sprinkler system being arranged in the second mode such that the sprinkler system applies water to the area to suppress an approaching fire.

2. The apparatus according to claim 1 wherein the fence arrangement includes a top rail which forms a pipe for the sprinkler system.

3. The apparatus according to claim 1 wherein the sprinkler system includes a first set of nozzles for spraying herbicide to inhibit vegetation on either side of the fence and a second set of nozzles for spraying water for dousing a fire adjacent the fence.

* * * * *